US005213255A

United States Patent [19]

Cote

[11] Patent Number: 5,213,255

[45] Date of Patent: May 25, 1993

[54] OPENING STRUCTURE FOR WEDGE-SHAPED PIE CARTON

[75] Inventor: Raymond A. Cote, Taylorsville, N.C.

[73] Assignee: Waldorf Corporation, St. Paul, Minn.

[21] Appl. No.: 939,581

[22] Filed: Sep. 3, 1992

Related U.S. Application Data

[63] Continuation of Ser. No. 739,991, Aug. 2, 1991, abandoned, which is a continuation-in-part of Ser. No. 693,864, May 1, 1991, abandoned.

[51] Int. Cl.[5] ..... B65D 5/54

[52] U.S. Cl. ..... 229/115; 229/160.2; 229/223; 229/243; 229/925

[58] Field of Search ..... 229/115, 160.2, 223, 229/224, 225, 226, 243, 925; 206/551

[56] References Cited

U.S. PATENT DOCUMENTS

| | | | |
|---|---|---|---|
| D. 272,806 | 2/1984 | Handy et al. . | |
| 2,299,461 | 10/1942 | Clanon | 229/225 |
| 2,361,659 | 10/1944 | Smith | 229/225 |
| 2,946,499 | 7/1960 | Creelman | 229/225 |
| 3,168,233 | 2/1965 | Ignell | 206/626 |
| 3,310,222 | 3/1967 | Buttery | 229/226 |
| 3,426,955 | 2/1969 | Olson | 206/626 |
| 3,486,682 | 12/1969 | Mahon et al. | 229/225 |
| 3,522,907 | 8/1970 | Utterback, Jr. | 206/629 |
| 3,618,848 | 11/1971 | Pawlowski | 229/243 |
| 3,797,728 | 3/1974 | Buttery et al. | 206/625 |
| 3,861,583 | 1/1975 | Tingley et al. | 206/629 |
| 4,105,155 | 8/1978 | Forbes, Jr. | 206/626 |
| 4,313,542 | 2/1982 | Roberts et al. | 229/115 |
| 4,317,518 | 3/1982 | Mode | 229/925 |
| 4,432,489 | 2/1984 | Cote | 229/115 |
| 4,432,490 | 2/1984 | Roberts . | |
| 4,477,014 | 10/1984 | Brandenburger . | |
| 4,492,333 | 1/1985 | Roberts . | |
| 4,613,046 | 9/1986 | Kuchenbecker | 206/626 |
| 4,798,323 | 1/1989 | Platt . | |
| 4,836,438 | 6/1989 | Rigby . | |
| 4,863,021 | 9/1989 | Crittenden . | |
| 4,945,711 | 8/1990 | Crittenden . | |
| 4,967,911 | 11/1990 | Lo Duca | 206/626 |
| 5,009,320 | 4/1991 | Kramer | 206/625 |

FOREIGN PATENT DOCUMENTS

| | | | |
|---|---|---|---|
| 112505 | 12/1968 | Denmark | 206/626 |
| 1419392 | 10/1965 | France | 206/626 |
| 1428558 | 1/1966 | France | 206/626 |
| 1471277 | 1/1967 | France | 206/626 |

*Primary Examiner*—Gary E. Elkins
*Attorney, Agent, or Firm*—Dorsey & Whitney

[57] ABSTRACT

In accordance with the present invention, a carton for containing and protecting a single, wedge-shaped piece of dessert-type pie is provided. The carton comprises generally parallel, triangular top and bottom panels each having a base edge and converging side edges. A trapezoidal rear wall is foldably coupled to the base edges and extends between the top and bottom panels. An inner side wall panel is foldably coupled to each of the converging edges of the bottom panel and extends generally straight upwardly therefrom. An outer side wall panel is foldably connected to each of the converging edges of the top panel and extends generally straight downward therefrom. The outer side panels are closely adjacent to, overlying and affixed along one edge to the inner side wall panels. Each outer side wall panel has an opening structure comprised of a generally central, deflectable, finger-receiving opening tab and a line of weakness generally collinear with the opening tab. The line of weakness includes two spaced lines of intermittent incisions which diverge from the opening tab at an angle with respect to one another in the direction of the ends of the outer side wall panels. The invention also encompasses a flat blank for forming into the carton and another embodiment wherein the opening structure includes a generally central, finger-operated opening edge and lines of weakness extending from the opening edge.

33 Claims, 8 Drawing Sheets

OPENING STRUCTURE FOR WEDGE-SHAPED PIE CARTON

This application is a continuation of application Ser. No. 07/739,991, filed Aug. 2, 1991, now abandoned, which was a continuation-in-part of application Ser. No. 07/693,864, filed May 1, 1991, now abandoned.

TECHNICAL FIELD

The present invention relates to paperboard packages for food items. More particularly, the present invention relates to a carton, including an improved opening structure that facilitates access to the contents, for containing and protecting a single, wedge shaped piece of dessert-type pie.

BACKGROUND OF THE INVENTION

It is known in the prior art to use generally triangular cartons for packaging wedge or triangular shaped food items. U.S. Pat. No. 4,798,323 (to Platt) discloses a wedge shaped folding carton for packaging pizza slices. Although well-suited for its intended purpose, the disclosed package may not provide adequate support and protection for the typically fragile crust of dessert-type pies. Additionally, the disclosed carton does not provide access to the contents through an unobstructed top opening.

U.S. Pat. Nos. 4,432,490 (to Roberts) and 4,492,333 (also to Roberts), owned by the assignee of the present invention, are directed to providing a carton for containing single servings of dessert-type pies. In particular, the Roberts patents are directed to providing a carton having adequate strength to protect fragile slices of pie. The disclosed cartons also are designed for inexpensive, efficient production and forming of the carton from a single blank of paperboard material. While these cartons represent improvements in cartons for containing single servings of dessert-type pies, they require consumer manipulation of rear closure flaps to gain access to the contents. Typically, these flaps are affixed or attached to each other by adhesive or other means. The cartons disclosed in the Roberts patents disclose no special opening structure to facilitate the manipulation of the rear flaps or to otherwise gain access to the contents.

U.S. Pat. Nos. 4,313,542 (to Roberts, et al.) and 4,432,489 (to Cote), also owned by the assignee of the present invention, disclose cartons especially adapted for packaging single servings of dessert-type pie. The cartons disclosed in these latter two patents include wall and flap structures designed to protect fragile pie crusts and include completely removable tear strips for opening the carton and for providing completely open, top access to the contents. However, these cartons do not maximize cost efficiency in the production. Further, they cause excess litter and a clean-up problem, because the completely removable tear strips may not always be neatly discarded.

U.S. Pat. No. 4,477,014 (to Brandenburger) overcomes some of the problems of the prior art mentioned above. The Brandenburger patent is directed to a generally triangular paperboard carton having a carton closure arrangement including means for grasping and separating the cover portion from the body portion of the carton to open the carton. However, the disclosed carton may be weakened because weakened lines of tear are located along the long edges of the cover portion just where that portion is joined to the sides of the carton. Also, the means for grasping and separating comprises a tab located at the apex of the triangularly shaped carton, and it may be difficult to deflect the carton side wall sufficiently to grasp the tab because at the apex, four side wall panels and a front corner flap are adjacent and secured to each other. Because the tab is at one end of the carton, a force applied thereto may cause twisting of the carton, damaging the pie and making the product less attractive to a consumer. Although, it discloses a rectangular box carton, not a triangular carton for containing a single piece of pie, U.S. Pat. No. 4,836,438 (to Rigby) discloses a carton having opener panel with an opening tab, located at a corner of the carton, that is somewhat similar to the tab in the Brandenburger patent. The tab 42 in Rigby's carton that is located in the center of the opener panel is a "carton reclosure tab", apparently not used to facilitate opening.

It is clear that with the current packaging methods for single servings of dessert-type pies, cost efficient production, product protection, litter prevention and easy access to the contents are not enhanced to an optimum degree. Accordingly, there is need for a strong, efficient, easily opened, disposable paperboard package for containing single servings of dessert-type pies.

SUMMARY OF THE INVENTION

In accordance with the present invention, a carton for containing and protecting a wedge shaped single serving of dessert-type pie is provided. The carton comprises generally parallel, triangular top and bottom panels each having a base edge and converging side edges. A trapezoidal rear wall is foldably coupled to the base edges and extends between the top and bottom panels. When the carton is fully erected, the trapezoidal rear wall extends upward from the bottom panel base edge at an angle toward the top panel base edge. An inner side wall panel is foldably coupled to each of the converging edges of the bottom panel, extending generally straight upward therefrom. An outer side wall panel is foldably connected to each of the converging edges of the top panel, extending generally straight downward therefrom, whereby each outer side panel is closely adjacent to, overlying and affixed to the corresponding inner side wall panel. Each outer side wall panel has an opening structure comprised of a generally central, deflectable, finger-receiving opening tab and a generally central line of weakness collinear with the opening tab. The line of weakness is formed by the opening tab and two spaced lines of intermittent incisions which diverge from said opening tab at an angle with respect to one another in the direction of the ends of said outer side wall panels. The invention also encompasses a flat blank for forming into the carton.

In another embodiment of the carton of the present invention, the opening structure comprises a generally central, finger receiving opening edge and generally central lines of weakness extending from either side of the opening edge. The opening edge is formed by a substantially continuous arcuate or curved cut, the central portion of the arc or curve being the portion most closely adjacent the top panel (i.e., the arc or curve is concave downward in the finished carton). The lines of weakness are formed by two spaced lines of intermittent incisions, each of which diverges from one end of the opening edge and extends in the direction of one end of the outer side wall panel in which it is located. A flat blank for forming into this embodiment of the present invention is encompassed.

An object of the present invention is to provide a carton that is strong enough to adequately protect a single piece of dessert-type pie contained therein.

Another object of the present invention is to provide a carton adapted for containing and protecting a single serving of pie that includes an opening structure for facilitating consumer access to the pie and for minimizing the chance of breaking the pie crust during the opening of the carton.

Yet another object of the present invention is to provide a carton which is cost effective to produce and which conserves valuable resources, yet provides tamper evidence, adequately protects the contents and enables easy consumer access.

Still another object of the present invention is to provide a carton for a single piece of dessert-type pie, wherein the carton includes an opening structure that facilitates access to the contents, yet minimizes litter and disposal problems because the carton is designed to remain in one piece following its opening.

An important advantage of the present invention is that it combines specific shipping and packaging advantages, such as reduced breakage of fragile pieces of pie, with specific point-of-use advantages, such as improved opening characteristics and neatness of disposal.

Another advantage of the present invention is that the opening structure, and specifically, the tab or edge used to initiate opening, is located in the generally central area of the side walls of the carton rather than at a corner or edge where a number of panels, flaps or edges thereof meet or overlie one another. Thus, the tab or edge is positioned where the carton wall and the tab or edge may be manipulated or deflected more easily to facilitate grasping it. Additionally, the generally central and coplanar position of the opening tab or edge with respect to the outer side wall eliminates the need for a tab that protrudes or extends from a free edge of one of the carton wall panels, yet does not diminish the ease of opening the carton.

Other advantages of the present invention are that it provides for the efficient use of resources by minimizing the amount of paperboard required to form the package; it also allows for faster, more cost efficient assembly and gluing, because the adhesive material, or activation thereof, is accomplished in a single linear pass, without the need to time or break the application of the glue or heat to avoid the opening structure. Other objects and advantages of the present invention will become more fully apparent and understood with reference to the following specification and to the appended drawings and claims.

DETAILED DESCRIPTION OF THE PREFERRED EMBODIMENT

Figure 1:
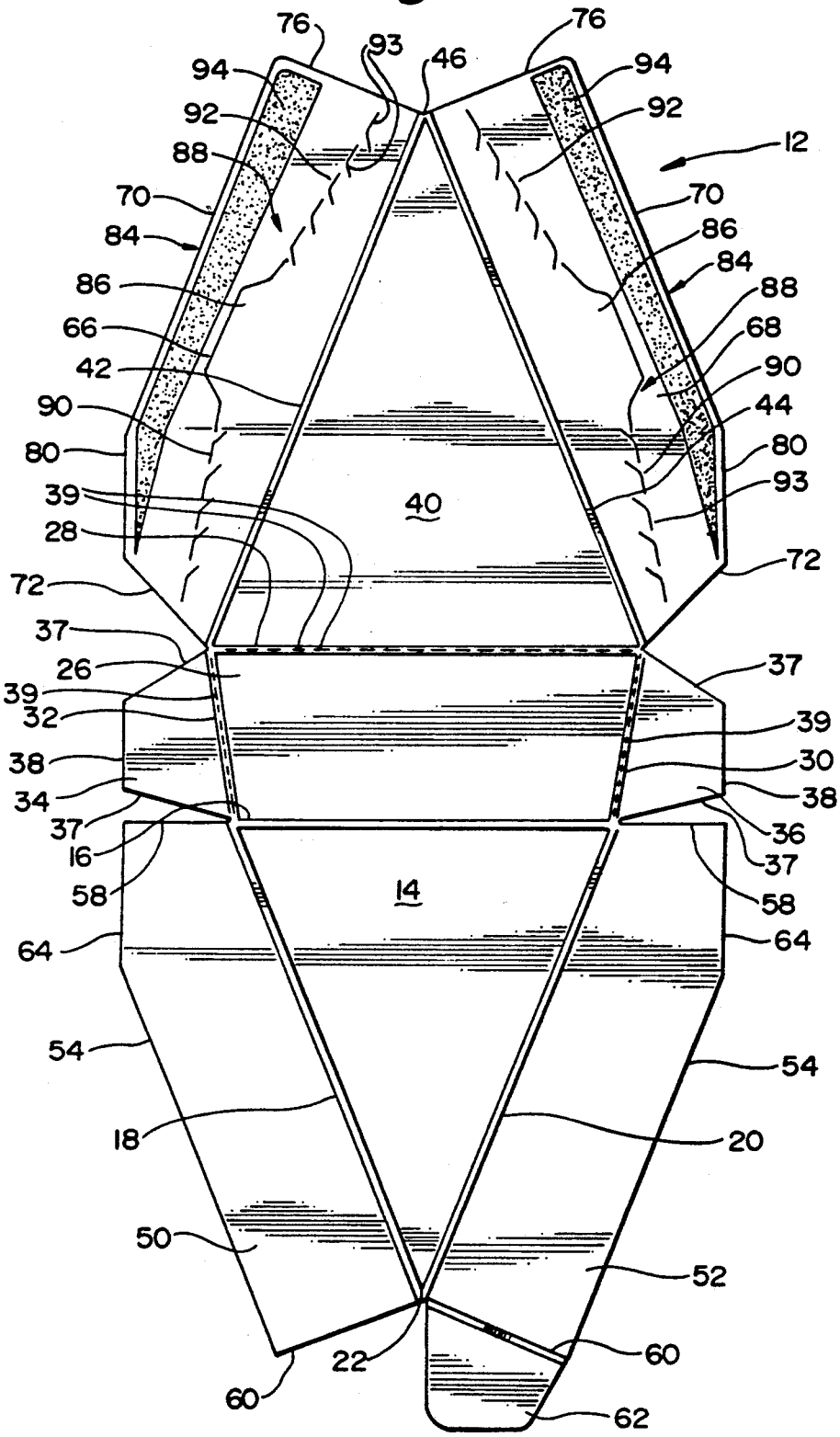
FIG. 1 is a top plan view of the blank from which the carton of the present invention is formed and shows the die-cut profile thereof.

Referring to FIG. 1, a blank 12 in accordance with the present invention is provided for forming into a generally triangular carton 13 (see FIG. 5) for containing a single piece of pie. The blank 12 has a generally triangular bottom panel 14 having a lower base edge 16 and converging side edges 18, 20. The side edges 18, 20 converge at a bottom panel apex 22. A generally rectangular, preferably trapezoidal, rear end wall panel 26 is foldably connected to bottom panel 14 along the lower base edge 16. The rear wall 26 has an upper base edge 28 that is generally parallel to the lower base edge 16. The rear panel 26 also has non-parallel side edges 30, 32. A minor rear closure panel 34, 36 is foldably connected to each side edge 32, 30 of the rear panel 26, respectively. The free side edges 37 of the minor closure panels 34, 36 are cut at an angle with respect to the base edges 16, 28. The free end edge 38 is straight and non-parallel to the side edges 32, 30 of the rear panel 26.

In the drawings, double lines indicate fold lines, single solid lines indicate cuts, scores or free edges, and broken single lines indicate intermittent cuts or incisions for forming lines of weakness. For example, reference to FIG. 1 shows that the base edge 16 of the rear panel 26 is a fold line, while edges 28, 30, 32 are fold lines, each of which edges 28, 30, 32 includes a collinear line of perforations or cuts 39.

A triangular top panel 40 is foldably connected to the upper base edge 28 of the rear panel 26. Like the bottom panel 14, the top panel 40 includes two side edges 42, 44 defined by fold lines that converge at a top panel apex 46. The generally triangular top panel 40 has substantially the same shape as the bottom panel 14, but it is longer from the upper base edge 28 to the top panel apex 46 than the bottom panel 14 is from the base edge 16 to the bottom panel apex 22.

Thus, as is disclosed in U.S. Pat. No. 4,313,542, which disclosure is incorporated herein by reference, when the blank 12 is erected to form the carton 13 (see FIG. 4), the trapezoidal rear wall panel 26 will slant upwardly and outwardly from the base edge 16 toward the upper base edge 28.

With further reference to FIG. 1, inner side wall panels 50, 52 are foldably connected to the bottom panel 14 along the side edges 18, 20, respectively. Each side wall panel 50, 52 includes a free edge 54. The free edge 54 of each panel 50, 52 is generally parallel and opposite to the corresponding side edge 18, 20. Each side wall panel 50, 52 has two generally opposed ends, a rear end 58 and an apex end 60. A front closure tab 62 is foldably connected to the apex end 60 of one of the side wall panels 50, 52, in this instance, panel 52. Each bottom side wall panel 50, 52 has a linear cut edge 64 along the free edge 54 adjacent the rear end 58.

Outer side wall panels 66, 68 are foldably connected to the top panel 40 along the respective converging side edges 42, 44 of the top panel 40. Each outer side wall panel 66, 68 has a free edge 70 generally parallel and opposite to the respective side edges 42, 44 of top panel 40, and two free ends, a rear end 72 and an apex end 76. Each side wall panel 66, 68 includes a linear cut 80 along the free edge 70 adjacent to the rear end 72. Each linear cut 80 is collinear with the corresponding cut 64 of the bottom side wall panels 50, 52 and the free edge 38 of the minor closure panels 34, 36. Stripped out regions separate the minor closure panels 34, 36 from the ends 58, 72 of the side wall panels 50, 52, 66, 68.

Figure 4:
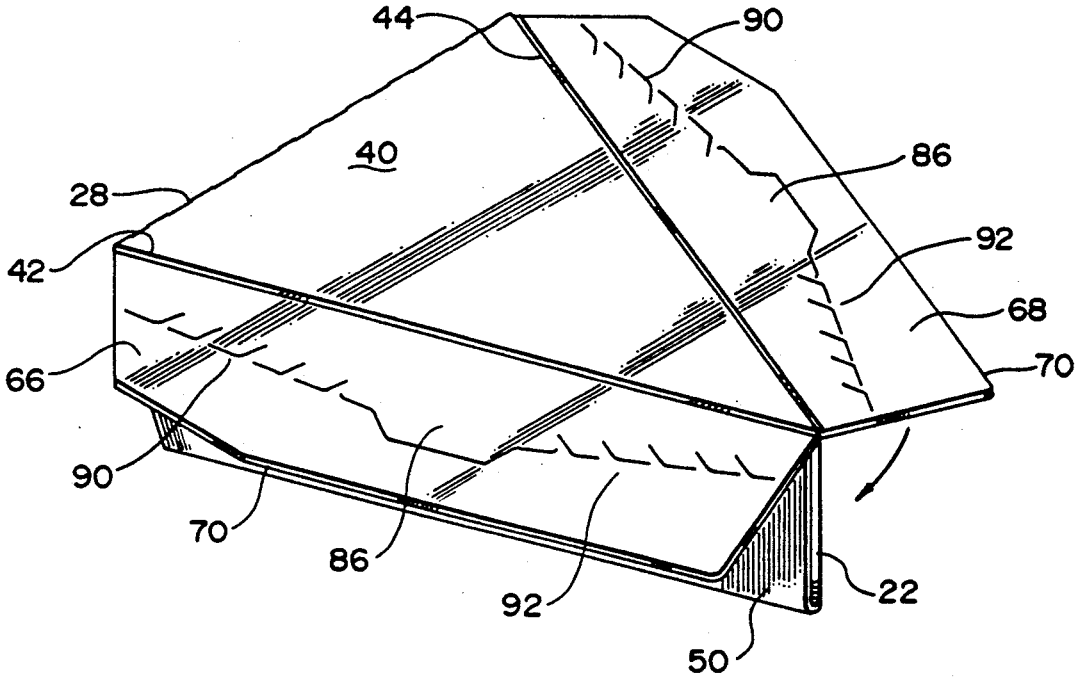
FIG. 4 is a perspective view of the carton of the present invention, showing an intermediate step in closing and sealing the carton.

The erected, unsealed carton 13 of the present invention, depicted in FIG. 4, includes a bilateral opening structure 84 in each of the outer side wall panels 66, 68. With reference to FIG. 1, the opening structure 84 comprises a generally central, deflectable, finger operated opening tab 86 defined by a cut in each side wall panel 66, 68. A line of weakness 88 extends from each end of the tab 86 generally across and along the central longitudinal length of each side wall panel 66, 68. The line of weakness 88 extends from either end of the opening tab 86 in the form of two spaced, diverging tearable lines of weakness 90, 92. The lines 90, 92 diverge from the opening tab 86 at an angle toward the free ends 72, 76 of the outer side wall panels 66, 68. The lines 90, 92 are formed by a plurality of angled, intermittent incisions or cuts 93. The bottom segments of each incision 93 are collinear. Adhesive or glue areas 94 are provided on each outer side wall panel 66, 68 between the opening structure 84 and the free edge 70.

Figure 2:
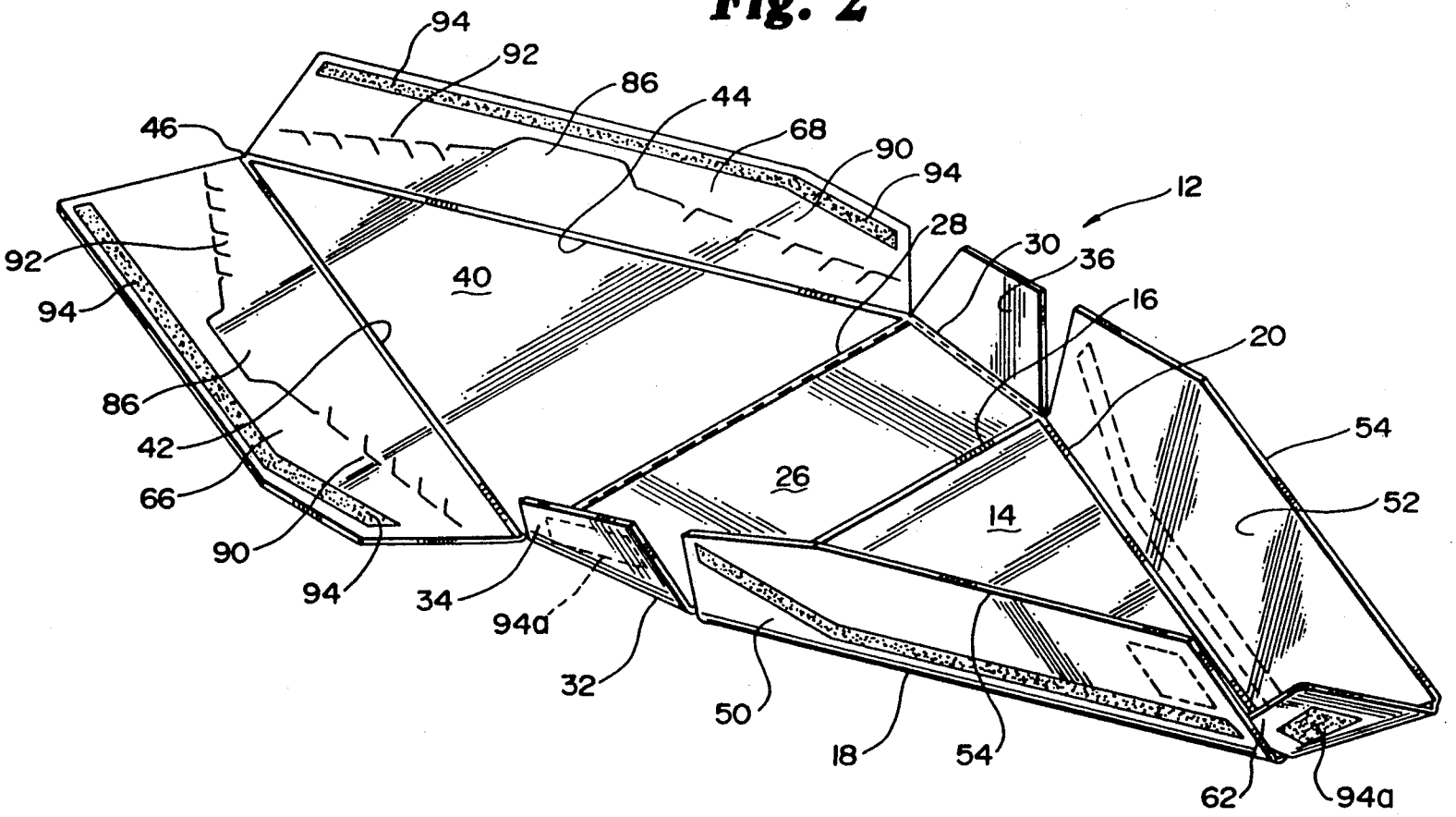
FIG. 2 is a perspective view showing the partial erection of the blank shown in FIG. 1.
Figure 3:
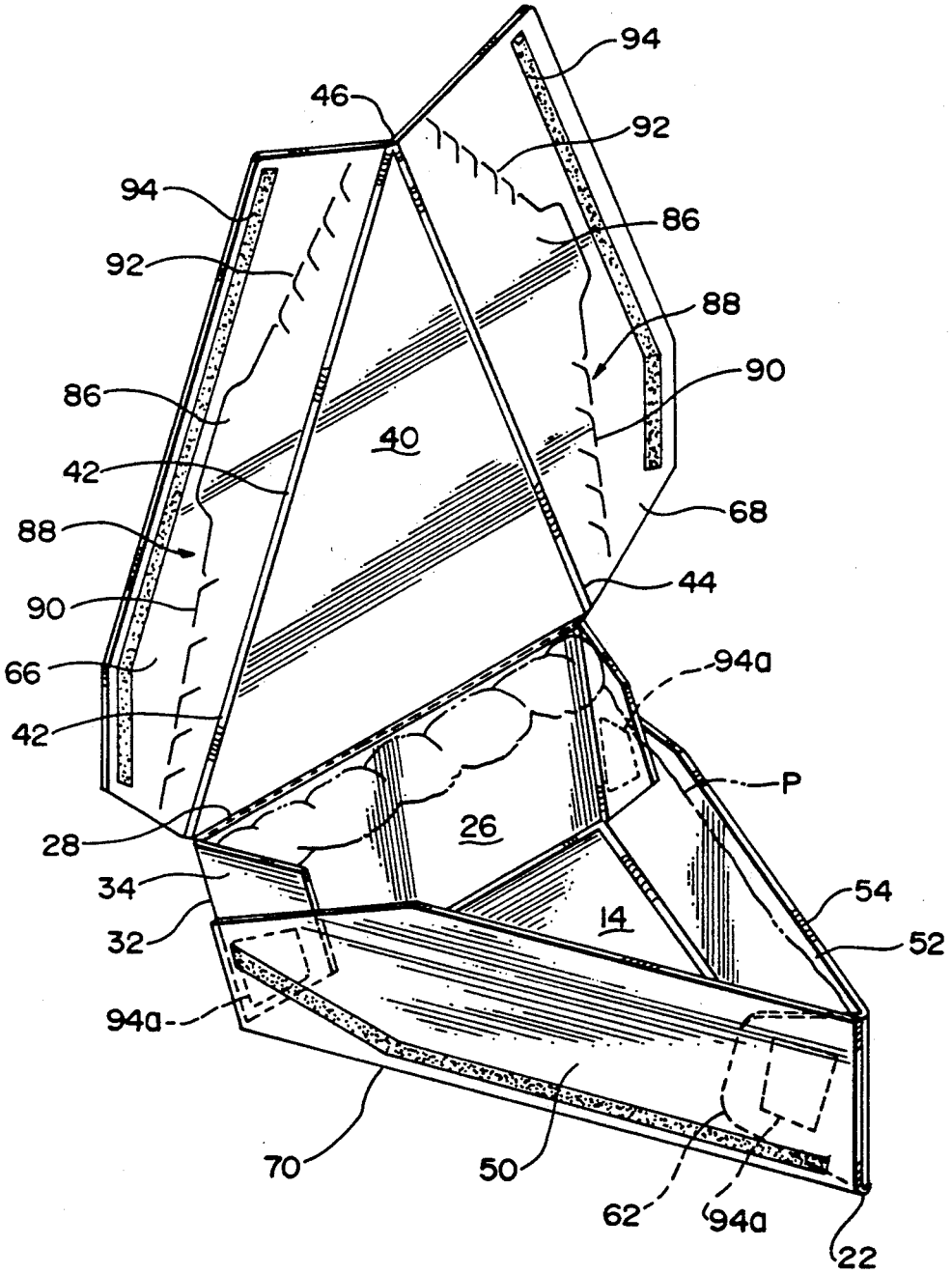
FIG. 3 is a perspective view of the carton of the present invention erected and filled prior to sealing.
Figure 5:
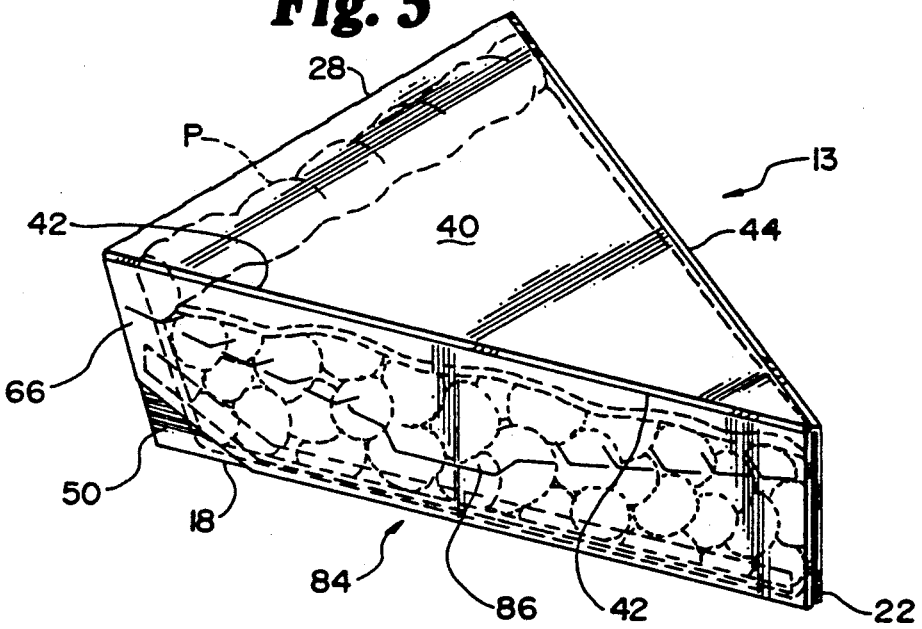
FIG. 5 is a perspective view of the carton of the present invention, showing the carton filled and sealed.

With regard to the erection of the blank 12, a completed carton 13 formed from the blank 12 is depicted in FIG. 5. FIGS. 2 and 3 depict steps in the erection sequence. To form the carton 13, the blank 12 is folded about the converging side edges 18, 20 of the bottom triangular panel and about foldlines 30, 32 at the edges of the rear panel 26 so that the minor rear closure panels 34, 36 and the bottom side wall panels 50, 52 are brought into generally perpendicular upstanding relation with respect to the bottom panel 14. Generally simultaneously, the front closure tab 62 may be folded inwardly in the direction of the inner side wall panel 52 to which it is attached, whereby it will be adjacent to the inner side of the side wall panel 50 to which it is not attached, as depicted in FIG. 3.

With further reference to FIG. 3, the minor rear closure panels 34, 36 and the front closure tab 62 are secured to the inner side wall panels 50, 52 at adhesive areas 94*a*. The contents, a wedge-shaped single serving of dessert-type pie P may be placed into the carbon 13 as depicted in phantom in FIG. 3. During the loading of the pie P into the carton 13, the top panel 40 may be reverse folded outwardly away from the interior of the carton 13 along the upper base edge fold line 28. The reverse folding of the top panel 40 is facilitated by the line of cuts 39 collinear with the upper base edge 28.

With reference to FIGS. 4 and 5, the top panel 40 is folded downward to overlie the contents and the outer side wall panels 66, 68 are folded downward in the direction of the inner side wall panels 50, 52 until they are overlying and closely adjacent to or contacting the inner side wall panels 50, 52. The inner and outer side wall panels 50, 52 and 66, 68, respectively are attached or connected to each other at the adhesive areas 94, which (like areas 94*a*) bear a suitable adhesive applied before beginning the folding and erection sequence depicted in FIGS. 2, 3 and 4, or are coated with heat activated adherent means. In either case, the adhesive may be applied or activated with a single linear motion across the lower edge of the wall panels bearing the adhesive. The connection between the side wall panels 50, 52 and 66, 68 substantially seals the carton, because, even though the outer side wall panels 66, 68 include the opening structures 84, they overlie the inner side wall panels 50, 52 which are coextensive with the side of the carton 13 and have substantially the same surface area as the outer wall panels 66, 68. Moreover, the opening structures 84 preferably include only limited incisions and the inner side wall panels 50, 52 preferably extend essentially the full height of the carton 13.

Figure 6:
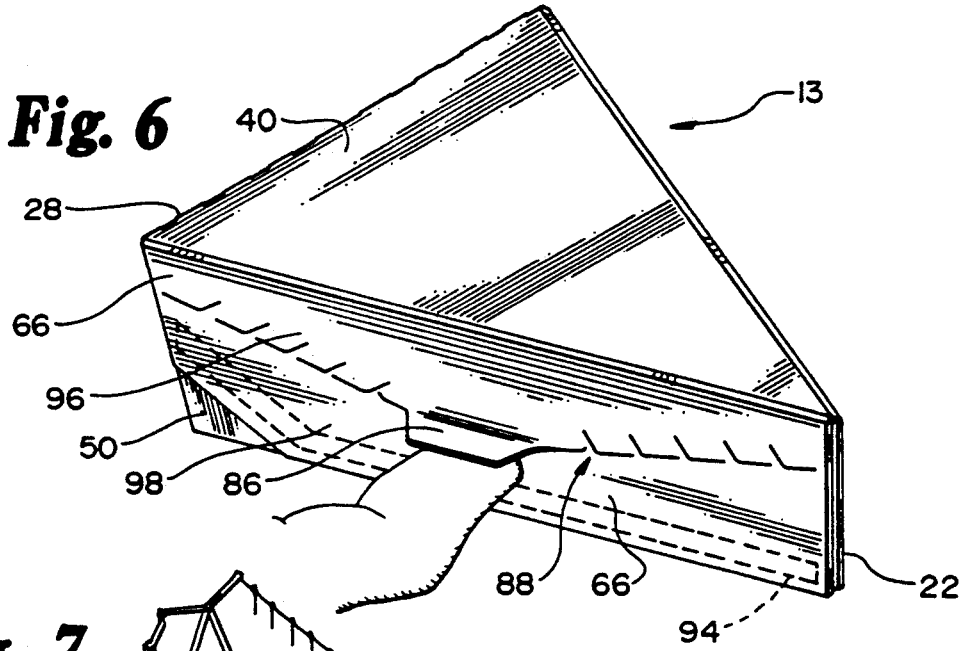
FIG. 6 is a perspective view depicting the opening of the carton.
Figure 7:
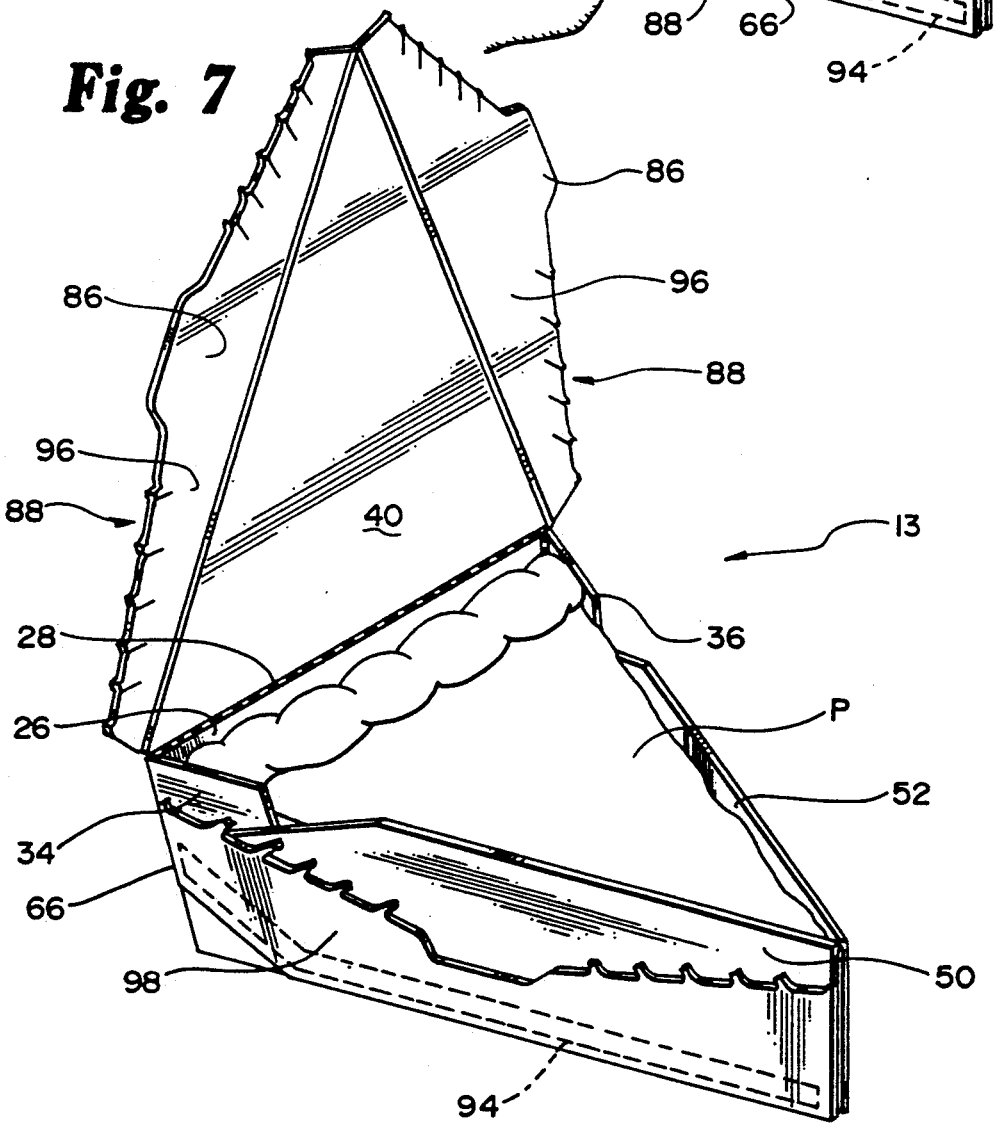
FIG. 7 is a perspective view of the carton opened, showing the pie therein.

FIGS. 6 and 7 are provided to depict the opening of the carton 13 of the present invention. Specifically, as shown in FIG. 6, a consumer's finger may be inserted behind the opening tab 86 in each outer side wall panel 66, 68 by slight deflection of the tab 86 and the adjacent inner side wall panel 50 or 52. A generally upward and outward lifting or tearing force applied to the finger opening tab 86 causes the separation of a generally upper portion 96 of the outer side wall panel 66, 68 from a lower portion 98 thereof along the line of weakness 88. (The lower portions 98 of the outer side wall panels 66, 68 remain affixed to the inner side wall panels 50, 52.) Once this is done on both sides, the top panel 40 may then be rotated along the upper base edge 28 to the position depicted in FIG. 7, wherein the piece of pie P in the carton 13 is exposed. The sealed carton 13 and the opening structure 84 will thus provide evidence of attempted tampering, because the only way to access the contents of the carton 13 is to manipulate the opening tab 86 and tear the tearable lines 90, 92 substantially along their entire length.

It should be appreciated that the carton material comprising the top panel 40 and the upper portions 96 of the outer side wall panel 66, 68 may be, if desired, removed from the remainder of the carton 13 along the upper base edge 28 by tearing along that edge 28. However, it is anticipated that most users will leave the opened carton 13 intact, using it as a tray or dish.

Figure 8:
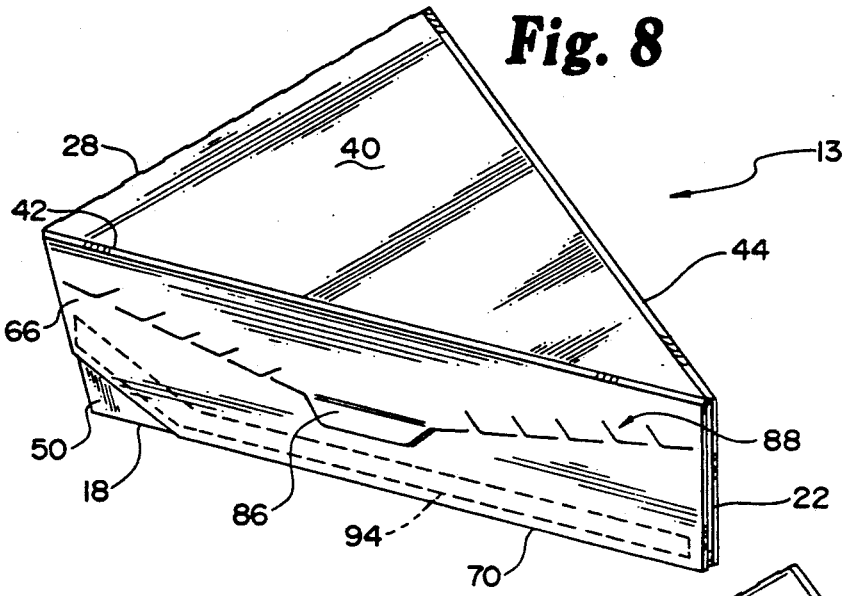
FIG. 8 is a perspective view of a first alternative embodiment of the present invention.
Figure 9:
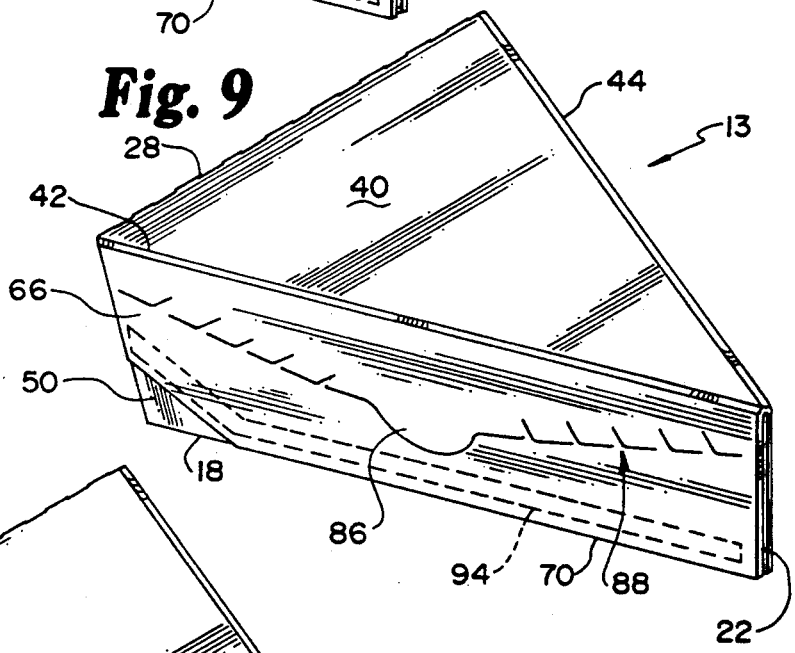
FIG. 9 is a perspective view of a second alternative embodiment of the present invention.
Figure 10:
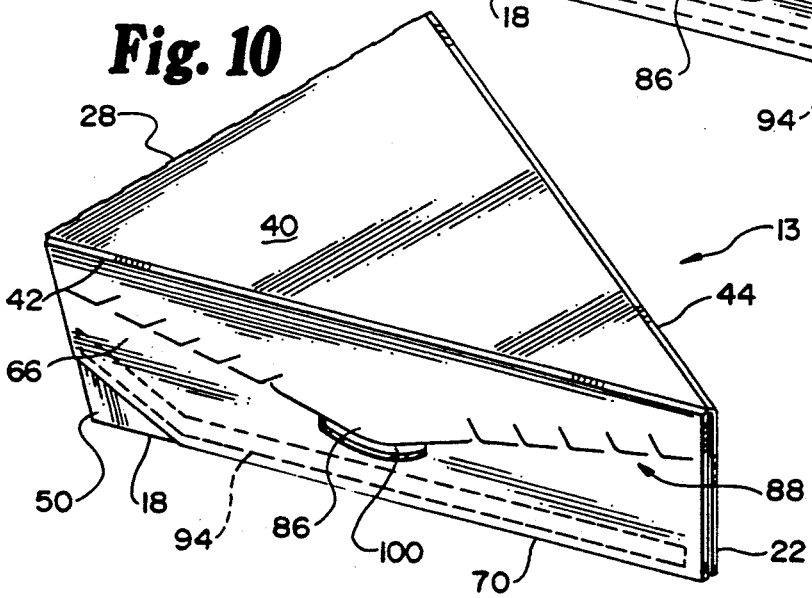
FIG. 10 is a perspective view of a third alternative embodiment of the present invention.

FIGS. 8–10 depict alternative embodiments of the present invention. Specifically, in FIG. 8 the opening tab 86 is embossed to further facilitate the insertion of a consumer's finger behind the tab 86 as depicted in FIG. 6. In FIG. 9, the opening tab 86 is a crescent shaped tab, and in FIG. 10, a finger receiving stripped out area 100 is provided just beneath the opening tab 86. In each of the alternative embodiments, the opening tab 86 is formed of a single continuous cut line; only the configuration of the cut line is different. Likewise, the operation of the opening tab 86, and the carton 13 generally, is the same as discussed hereinabove with regard to the preferred embodiment.

Figure 11:
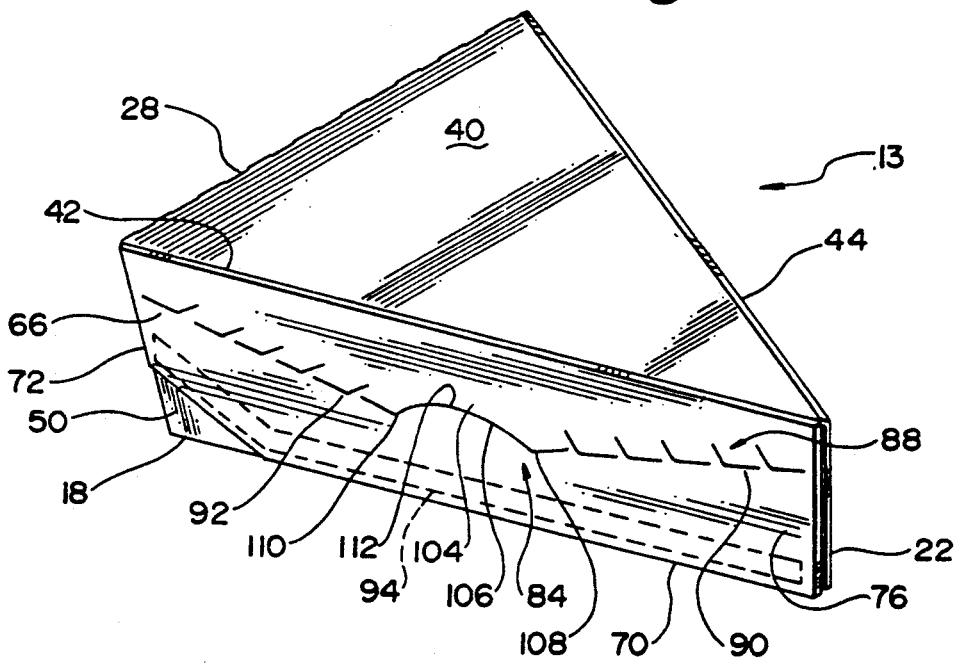
FIG. 11 is a perspective view of another embodiment of the present invention.
Figure 12:
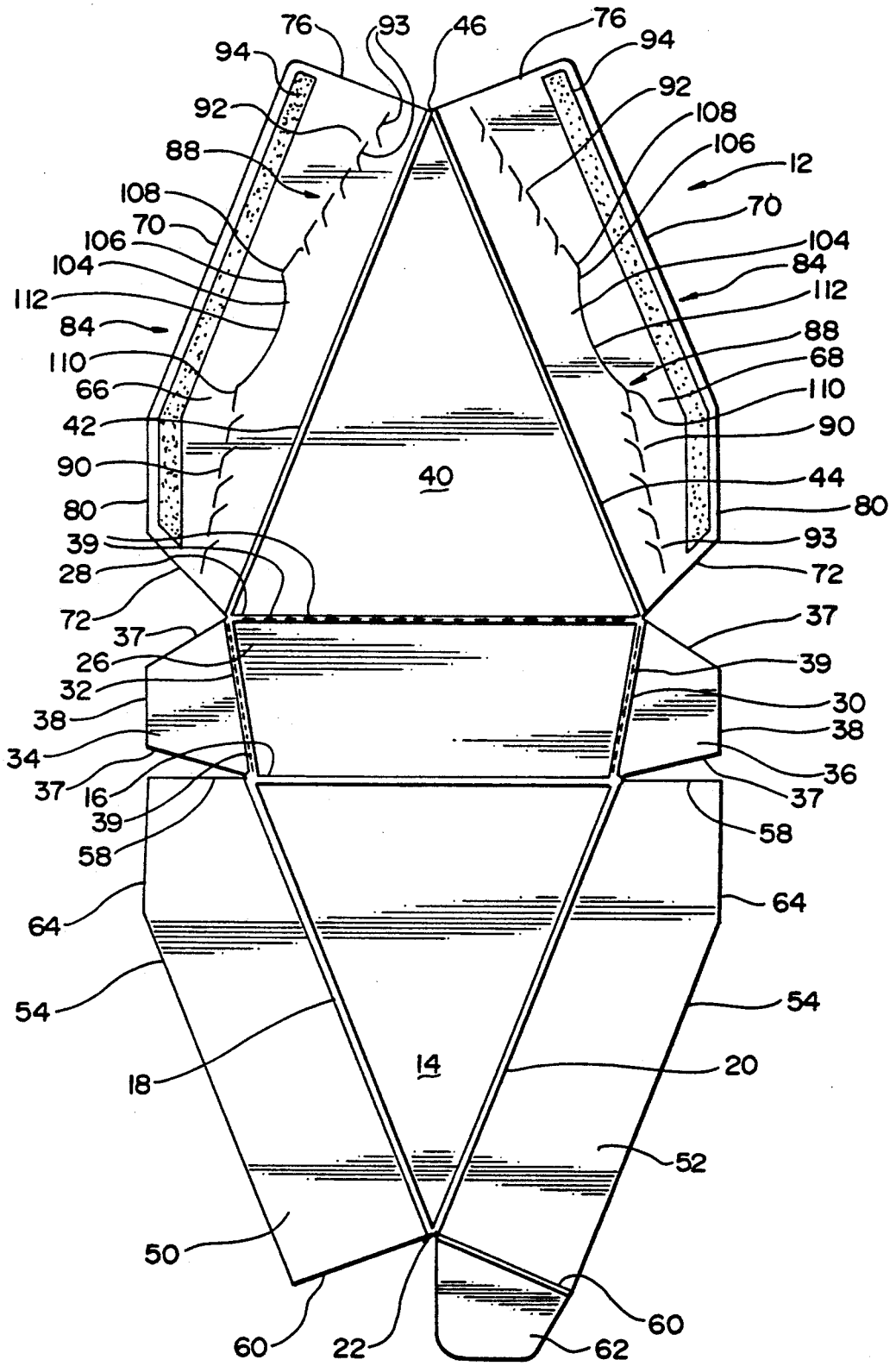
FIG. 12 is a top plan view of the blank from which the carton of the embodiment depicted in FIG. 11 is formed and shows the die-cut profile thereof.

FIGS. 11 and 12 depict another embodiment of the present invention. The features of this embodiment of the carton 13 correspond substantially to the embodiments depicted in the foregoing FIGS. 1–9, and corresponding elements are identified by the same numerals. Referring to FIGS. 11 and 12, the opening structures 84 of this embodiment each comprise a generally central, finger operated opening edge 104 formed by a substantially continuous arcuate or curved cut 106 in each side wall panel 66, 68. The cut has ends 108, 110 and an uppermost central area 112. The central area 112 is that portion of the cut 106 most closely adjacent the top panel 40.

The opening structures 84 also include a line of weakness 88 comprising two spaced, diverging tearable lines of weakness 90, 92 that diverge from the opening edge 104, specifically from adjacent the ends 108, 110 of the cut 106, at an angle toward the free ends 72, 76 of the outer side wall panels 66, 68.

Although an arcuate opening edge 104 (and cut 106) is depicted in FIGS. 11 and 12, the shape of the edge 104 can be varied. The degree of curvature can be more or less than that shown, or the edge could be piecewise linear segments forming a curve. Additionally, a nick (not shown) could be provided to interrupt the cut 106 at the central area 112 to assist in keeping the edges 104 in their closed, coplanar relation to the panels 66, 68 and to assist in providing tamper evidence.

In use, much as shown in FIG. 6, a consumer's finger may be placed just beneath the opening edge 104 in each outer side wall panel 66, 68. Slight inward pressure exerted on the wall panels 66, 68 causes the panels 66, 68 to deflect or move slightly toward the carton interior, thereby altering the generally coplanar relationship between the opening edges 104 and the panels 66, 68, in effect, deflecting or causing the opening edge 104 to be outwardly of the lower portion 98 of the wall panels 66, 68. The consumer may conveniently and easily exert a generally upward and outward lifting force on the opening edge 104, causing the separation of the generally upper portion 96 of the outer side wall panel 66, 68 from the lower portion 98 along the line of weakness 88. For most users, the inward deflection and grasping of edge 104 is easier to effect and makes opening easier than in the preceding embodiments (FIGS. 1–10). When the lines of weakness 88 are torn completely, the top panel 40 may be rotated around the upper base edge 28 to expose the piece of pie P in the carton 13.

A number of variations of the present invention can be made. For example, cartons 13 of various sizes may be provided to accommodate different sizes of pieces of pie. While the container 13 is most suitably formed in a wedge or triangular shape, other container shapes, such as circular or polygonal could be used; the carton 13 may be adapted to fit the shape of the product to be contained therein. The resilient paperboard from which the present invention is fabricated may be of any suitable composition and may be coated with appropriate substances to impart desirable characteristics, such as resistance to liquids. The location and configuration of the adhesive area 94 and 94*a* may be varied as long as the lower portions 98 of each outer side wall panels 66, 68 are held securely to the inner side wall panels 50, 52. Various methods might be used to hold the carton 13 in the closed position shown in FIG. 5; such methods include the use of various adhesives, heat activated substances, or systems of interlocking tabs. Both the interior or exterior of the completed carton 13 may be marked with appropriate indicia.

It should be understood that as an alternative to erecting and gluing the blank 12 into the completed carton 13, the producer may provide the blank 12 in a completely flat, unerected condition, partially erected, or fully erected and ready to be filled as shown in FIG. 3. Thus, the purchaser of the carton 13 of the present invention has the option of how to purchase the package; if the person purchases the blanks 12 in flat condition, appropriate instructions may be provided on how to form the blanks 12 into the carton 13 for receiving contents.

Although the description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than the foregoing description to indicate the scope of the invention.

What is claimed is:

1. A flat blank for forming a carton for containing a generally triangular food item such as a single piece of dessert-type pie, said blank comprising:

a triangular bottom panel having a base edge and two side edges;

a trapezoidal rear wall having top, bottom and side edges, with said bottom edge of said rear wall and said base edge of said bottom panel being hingedly connected and of equal length, and with minor closure panels being connected to the side edges of said trapezoidal rear wall;

a triangular top panel having a base edge and two side edges with the length of the base edge of said top panel being greater than the length of the base edge of said bottom panel, and with the length of said top panel being greater than the length of said bottom panel, said base edge of said top panel being hingedly connected and of equal length to the top edge of said trapezoidal rear wall; and a first pair of side wall panels, each side wall panel extending from and hingedly connected to one of the side edges of said triangular top panel and a second pair of side wall panels, each side wall panel of said second pair of side wall panels extending from and hingedly connected to one of the side edges of said triangular bottom panel, each of said first and second pairs of side wall panels including two opposed free ends and a free edge generally parallel to its hinged connection to a side wall, each one of said first pair of side wall panels including a generally central cut line adapted to form an opening structure, and each of said first pair of side wall panels further including a line of weakness extending from each side of said opening structure, each line of weakness extending toward one of said two opposed free ends, and wherein the blank has right and left sides and at least a portion of each said free edge of each of said side wall panels on the right side is collinear with the free edge of the other side wall panel on that side and at least a portion of each said free edge of each of said side wall panels on the left side is collinear with the free edge of the other side wall panel on that side.

2. An opening structure for a generally triangular, wedge-shaped carton for containing a food item such as a single piece of dessert-type pie, said carton having an apex, a base, and two converging side walls extending between said apex and said base, each said side wall formed by an inner side wall panel and an outer side wall panel parallel to said inner side wall panel, said opening structure formed in said outer side wall panels and comprising:

a generally central continuous cut through each of said outer side wall panels and a line of weakness diverging from each end of said cut, each said line of weakness extending toward one of said apex and said base.

3. The opening structure according to claim 2, wherein each of said outer side wall panels has a free edge and wherein said lines of weakness and said generally central continuous cut divide each of said outer side wall panels into an upper portion and a lower portion, said lower portion being adjacent to said free edge, said outer side wall panels being connected to said inner side wall panels at said lower portion.

4. The opening structure according to claim 3 wherein each generally central continuous cut is spaced inwardly from the free edge of the corresponding outer side wall panel and wherein said outer side wall panels are releasably connected to said inner side wall panels substantially along the entire length of said free edges of said outer side wall panels.

5. The opening structure according to claim 4 wherein the generally central continuous cut forming a portion of the opening structure is generally a curved arc.

6. The opening structure according to claim 2 wherein each line of weakness is formed by a sequence of intermittent incisions.

7. The opening structure according to claim 6 wherein each intermittent incision consists of a first segment, said first segments being substantially collinear, and a second segment intersecting said first segment at an angle.

8. The opening structure according to claim 3, wherein the ends of said generally central continuous cut are closer to said free edge than is the generally central area of said generally central continuous cut.

9. The opening structure according to claim 2, wherein the generally central continuous cut forms an opening edge extending above at least a portion of each said line of weakness.

10. A generally wedge-shaped paperboard carton for containing a single piece of dessert-type pie, said carton comprising:

a first triangular panel having a base edge, converging side edges and an apex;

a second triangular panel having a base edge, converging side edges and an apex, said second triangular panel spaced from and generally parallel to said first triangular panel;

a generally rectangular rear panel having two parallel sides, said rear panel foldably connected at a first of said parallel sides to said first triangular panel along said base edge of said first triangular panel and foldably connected at the second of said parallel sides to said base edge of said second triangular panel;

a pair of generally parallel inner side wall panels, each one of said inner side wall panels foldably connected to one of the converging side edges of said first triangular panel and extending generally toward said second triangular panel; and a pair of generally parallel outer side wall panels, each one of said outer side wall panels being foldably connected at a hinge edge of said outer panel to one of said converging side edges of said second triangular panel and extending generally toward said first triangular panel, each of said outer side wall panels having a pair of opposed free ends and a free edge generally opposite the hinge edge at which each is connected to said second triangular panel, each outer side wall panel further including a generally central opening edge and a line of weakness extending from each side of said opening edge toward the adjacent free end of said outer side wall panel.

11. The carton according to claim 10, wherein said outer side wall panels are adapted to closely overlie said inner side wall panels and are affixed to said inner side wall panels at an area adjacent said free edge of said outer side wall panels.

12. The carton according to claim 11, wherein a corner flap is foldably connected to one of said inner side wall panels adjacent the apex of said first triangular panel opposite its base edge.

13. The carton according to claim 10 wherein each opening edge is formed by a cut spaced inwardly from the free edge of the corresponding outer side wall panel.

14. The carton according to claim 13 wherein the cut forming the opening edge is an upwardly curved arc.

15. The carton according to claim 14 wherein the cut has two ends and a generally central area between said ends, and further wherein said ends are closer to said free edge than is the generally central area of said cut.

16. The carton according to claim 10 wherein the line of weakness is formed by a sequence of intermittent incisions.

17. The carton according to claim 16 wherein each intermittent incision consists of a first segment, said first segments being substantially collinear, and a second segment intersecting said first segment at an angle.

18. A flat blank for forming a carton for containing a generally triangular food item such as a single piece of dessert-type pie, said blank comprising:

a triangular bottom panel having a base edge and two side edges;

a trapezoidal rear wall having top, bottom and side edges, with said bottom edge of said rear wall and said base edge of said bottom panel being hingedly connected and of equal length, and with minor closure panels being connected to the side edges of said trapezoidal rear wall;

a triangular top panel having a base edge and two side edges with the length of the base edge of said top panel being greater than the length of the base edge of said bottom panel, and with the length of said top panel being greater than the length of said bottom panel, said base edge of said top panel being hingedly connected and of equal length to the top edge of said trapezoidal rear wall; and a first pair of side wall panels, each side wall panel extending from and hingedly connected to one of the side edges of said triangular top panel and a second pair of side wall panels, each side wall panel of said second pair of side wall panels extending from and hingedly connected to one of the side edges of said triangular bottom panel, each of said first and second pairs of side wall panels including two opposed free ends and a free edge generally parallel to its hinged connection to a side wall, each one of said first pair of side wall panels including a generally central cut line adapted to form an opening edge, and each of said first pair of side wall panels further including a line of weakness extending from each side of said opening edge, each line of weakness extending toward one of said two opposed free ends.

19. A flat blank for forming a carton for containing a generally triangular food item such as a single piece of dessert-type pie, said blank comprising:

a triangular bottom panel having a base edge and two side edges;

a trapezoidal rear wall having top, bottom and side edges, with said bottom edge of said rear wall and said base edge of said bottom panel being hingedly connected and of equal length, and with minor closure panels being connected to the side edges of said trapezoidal rear wall;

a triangular top panel having a base edge and two side edges with the length of the base edge of said top panel being greater than the length of the base edge of said bottom panel, and with the length of said top panel being greater than the length of said bottom panel, said base edge of said top panel being hingedly connected and of equal length to the top edge of said trapezoidal rear wall; and a first pair of side wall panels, each side wall panel extending from and hingedly connected to one of the side edges of said triangular top panel and a second pair of side wall panels, each side wall panel of said second pair of said side wall panels extending from and hingedly connected to one of the side edges of said triangular bottom panel, each of said first and second pairs of side wall panels including two opposed free ends and a free edge generally parallel to its hinged connection to a side wall, each one of said first pair of side wall panels including a generally central cut line adapted to form an opening edge, and each of said first pair of side wall panels further including a line of weakness extending from each side of said opening edge, each line of weakness extending toward one of said two opposed free ends, and wherein the blank has right and left sides and at least a portion of each said free edge of each of said side wall panels on the right side is collinear with the free edge of the other side wall panel on that side and at least a portion of each said free edge of each of said side wall panels on the left side is collinear with the free edge of the other side wall panel on that side.

20. A flat blank for forming a carton for containing a generally triangular food item such as a single piece of dessert-type pie, said blank comprising:

a triangular bottom panel having a base edge and two side edges;

a trapezoidal rear wall having top, bottom and side edges, with said bottom edge of said rear wall and said base edge of said bottom panel being hingedly connected and of equal length, and with minor closure panels being connected to the side edges of said trapezoidal rear wall;

a triangular top panel having a base edge and two side edges with the length of the base edge of said top panel being greater than the length of the base edge of said bottom panel, and with the length of said top panel being greater than the length of said bottom panel, said base edge of said top panel being hingedly connected and of equal length to the top edge of said trapezoidal rear wall; and a first pair of side wall panels, each side wall panel extending from and hingedly connected to one of the side edges of said triangular top panel and a second pair of side wall panels, each side wall panel of said second pair of side wall panels extending from and hingedly connected to one of the side edges of said triangular bottom panel, each of said first and second pairs of side wall panels including two opposed free ends and a free edge generally parallel to its hinged connection to a side wall, each one of said first pair of side wall panels including a generally central cut line adapted to form an opening structure, and each of said first pair of side wall panels further including a line of weakness extending from each side of said opening structure, each line of weakness extending toward one of said two opposed free ends, and wherein the blank has right and left sides and at least a portion of each said free edge of each of said side wall panels on the right side is collinear with the free edge of the other side wall panel on that side and at least a portion of each said free edge of each of said side wall panels on the left side is collinear with the free edge of the other side wall panel on that side.

21. A flat blank for forming a carton for containing a generally triangular food item such as a single piece of dessert-type pie, said blank comprising:

a triangular bottom panel having a base edge and two side edges;

a trapezoidal rear wall having top, bottom and side edges, with said bottom edge of said rear wall and said base edge of said bottom panel being hingedly connected and of equal length, and with minor closure panels being connected to the side edges of said trapezoidal rear wall;

a triangular top panel having a base edge and two side edges with the length of the base edge of said top panel being greater than the length of the base edge of said bottom panel, and with the length of said top panel being greater than the length of said bottom panel, said base edge of said top panel being hingedly connected and of equal length to the top edge of said trapezoidal rear wall; and a first pair of side wall panels, each side wall panel extending from and hingedly connected to one of the side edges of said triangular top panel and a second pair of side wall panels, each side wall panel of said second pair of said side wall panels extending from and hingedly connected to one of the side edges of said triangular bottom panel, each of said first and second pairs of side wall panels including two opposed free ends and a free edge generally parallel to its hinged connection to a side wall, each one of said first pair of side wall panels including a generally central cut line adapted to form an opening edge, and each of said first pair of side wall panels further including a line of weakness extending from each side of said opening edge, each line of weakness extending toward one of said two opposed free ends, and wherein the blank has right and left sides and at least a portion of each said free edge of each of said side wall panels on the right side is collinear with the free edge of the other side wall panel on that side and at least a portion of each said free edge of each of said side wall panels on the left side is collinear with the free edge of the other side wall panel on that side.

22. An opening structure for a carton, at least a portion of said carton being formed by an inner wall panel and an outer wall panel closely adjacent and parallel to the inner wall panel, said outer wall panel having a free edge, said opening structure formed in said outer wall panel and comprising a generally central continuous cut in said outer wall panel, said cut having two ends and a central part, and a line of weakness diverging at an angle from each end of said cut, said ends of said cut being closer to said free edge than the central part of said cut.

23. The opening structure according to claim 22, wherein the cut forms an opening edge extending above at least part of each of said lines of weakness.

24. The opening structure according to claim 23, wherein the cut forming the opening edge is curved.

25. The opening structure according to claim 22, wherein the carton has a top wall, said cut forming an arcuate opening edge having two ends and a central part, said lines of weakness diverging from each end of said cut at an angle toward said top wall, and at least a portion of said central part of said opening edge being above at least part of said lines of weakness.

26. An opening structure for a carton for containing food items, said carton having a top and bottom wall, a first end, a base, and two opposed side walls extending between said first end and said base, each said side wall formed by an inside wall panel and an outside wall panel, said outside wall panel closely adjacent and parallel to said inside wall panel and having a top edge and a free edge, said opening structure formed in said outside wall panels and comprising a generally central continuous cut, said cut having two ends and a middle portion, and a line of weakness diverging from each end of said cut, one of said lines of weakness extending towards said first end and the other of said lines of weakness extending towards said base, the ends of said cut being closer to the free edge than the middle portion of said cut, said middle portion being closer to said top edge than at least part of said lines of weakness.

27. The opening structure according to claim 26, wherein each said cut is curved.

28. The opening structure according to claim 27, wherein said lines of weakness angle toward said top wall and wherein each line of weakness is formed by a plurality of generally linearly aligned intermittent incisions.

29. The opening structure according to claim 28, wherein said lines of weakness and said cut divide said outer side wall panels into an upper portion and lower portion, said lower portion being adjacent to said free edge, said outside wall panels being connected to said inside wall panels adjacent said free edge.

30. An opening structure for a generally triangular carton for containing a single food item such as a single piece of dessert-type pie, said carton adapted to provide access to its contents thereof through an unobstructed top opening, said carton having parallel, triangular top and bottom walls each having a base edge with two ends and two converging side edges, one of said side edges extending from one of said ends of said base edge and the other of said side edges extending from the other of said ends of said base edge, said side edges converging at an apex corner, a trapezoidal rear wall foldably coupled to the base edges of the top and bottom walls and extending therebetween, and a pair of converging side walls extending between said trapezoidal rear wall and said apex and between the converging side edges of said top and bottom walls, each of said side walls including an inside wall panel, foldably connected to one of the converging side edges of the bottom wall, said inside wall panel being generally perpendicular to the bottom wall, and an outside wall panel, foldably connected to one of the converging edges of the top wall, said outside wall panel having a free edge parallel to the foldable connection to the top wall and being generally perpendicular to the top wall and overlaid, closely adjacent and parallel to said inside wall panel, said opening structure comprising a generally central, finger-receiving opening edge in each said outside wall panel, said opening edge being formed by a generally central curved cut having two ends and an arcuate central portion, said central portion being closer to said top wall than said ends, and two diverging lines of weakness including a single line of weakness extending at an angle from each one of said two ends of said cut, one of said lines of weakness extending toward said apex corner and the other of said lines of weakness extending toward said end of said base edge where said converging side edges of the top wall intersect said base edges, said central portion of said cut being closer to said top wall than at least part of said lines of weakness.

31. The opening structure of claim 30, wherein said lines of weakness are formed by a plurality of linearly aligned, spaced intermittent incisions.

32. The opening structure according to claim 31, said free edges of said outside side walls being closely adjacent to said converging said edges of said bottom panel, and wherein said overlaid, closely adjacent and parallel inside and outside side walls are connected to each other by connecting means for connecting the side walls, said connecting means being closely adjacent to the converging side edges of the bottom wall.

33. The opening structure according to claim 32, said inside and outside side walls having substantially the same surface area and being coextensive.

* * * * *